United States Patent [19]

Kluck

[11] Patent Number: 4,509,423

[45] Date of Patent: Apr. 9, 1985

[54] MULTI-POSITIONAL HANDLE FOR SEROGRAPHIC SCREEN

[76] Inventor: Robert S. Kluck, 14681 Pepper Tree Cir., Tustin, Calif. 92680

[21] Appl. No.: 527,556

[22] Filed: Aug. 29, 1983

Related U.S. Application Data

[63] Continuation-in-part of Ser. No. 401,725, Jul. 26, 1982, abandoned.

[51] Int. Cl.[3] ..... B05C 17/06

[52] U.S. Cl. ..... 101/127.1

[58] Field of Search ..... 101/127, 127.1, 128, 101/128.1, 128.4, 129, 114, 123, 124, 125

[56] References Cited

U.S. PATENT DOCUMENTS

| | | | |
|---|---|---|---|
| 2,015,087 | 9/1935 | Rafton | 101/127.1 X |
| 3,752,071 | 8/1973 | McKay | 101/127.1 X |
| 3,886,863 | 6/1975 | Carabott et al. | 101/127.1 X |
| 4,023,524 | 5/1977 | Goldfarb et al. | 101/127.1 X |

FOREIGN PATENT DOCUMENTS

| | | | |
|---|---|---|---|
| 866942 | 7/1949 | Fed. Rep. of Germany | 101/127.1 |
| 508328 | 6/1939 | United Kingdom | 101/127.1 |
| 361903 | 2/1973 | U.S.S.R. | 101/127.1 |

*Primary Examiner*—E. H. Eickholt

[57] ABSTRACT

A device for applying a pre-selected design to a surface, said device comprising a specially structured frame that supports a serigraphic screen and additionally accommodates a separate multi-positionable handle and a liquid hopper containing the color medium used to adorn surfaces by design transfer to horizontal, vertical, overhead, or oblique angle planes, all by means of a squeegee, or the like, at any of three hundred sixty degree (360°) orientations, and in mirror image.

7 Claims, 5 Drawing Figures

MULTI-POSITIONAL HANDLE FOR SEROGRAPHIC SCREEN

BACKGROUND OF THE INVENTION

The present invention is a continuation in part of Ser. No. 401,725 filed July 26, 1982 and now abandoned and relates to paint or ink transfer devices, and in particular to a single multi-purpose screen frame with accessories to permit transfer in any plane, using one of two assembly configurations, at any axis orientation of the pattern, and at random or selectable spacing.

The use and limitations of pattern transfer by silk screen are well known to the trade. Color medium containment when transferring in other than the horizontal plane is but one of them. Simultaneous with this is the inability of the squeegee and screen to adjust to surface irregulatities thereby limiting transfer to smooth surfaces. Although spray techniques have been used to handle such irregularities, spray containment has been a problem not yet satisfactorily resolved.

The present invention incorporates a frame plus accessory innovations that permit practice of the art in planes other than horizontal. Paint containment problems encountered when trying to use prior art devices in the vertical and overhead positions have been overcome by use of a specially designed removable hopper and handle.

It is accordingly an object of this invention to provide future practitioners of the art with an unlimited repertoire of decorative possibilities, such as a method of projecting a variety of guide images to direct his activities. An example would be, a uniform and closely spaced crosshatch image that, when superimposed by a given screen pattern, would simulate a mini wallpaper design.

SUMMARY OF INVENTION

A multi-positional transfer device employing a multipurpose frame comprises the foundation of the present invention. The primary function of the frame is to provide a plastic, metal, or wood supportive structure for a serigraphic screen or the like which is stretched and anchored between two symmetrical frame halves.

All frames, regardless of style, feature a quick disconnect handle means to secure a paint hopper in liquid-tight relationship to one of its faces. The handle and hopper are mountable on all sides of straight-sided frames, and at eight points or more, of a circular frame. These features allow the user full axis rotation of the screen pattern, while using the frame in the horizontal, vertical, or overhead planes. Additionally, the ability to mount the hopper to either face of the frame provides the user with mirror image transfer capabilities.

For horizontal plane "down" position transfer, no additional accessories other than the handle are required since the frame itself provides an adequate color medium reservoir.

To ready the frame for work on vertical surfaces, and to establish the desired pattern orientation, an open-style paint hopper is locked onto any one of the frame's four sides and selectably to either face, by a quick disconnect handle.

When other than random surface placement of the pattern is required, a grid generated image is projected onto the surface using a wide angle lens technique.

BRIEF DESCRIPTION OF THE DRAWING

The detailed description of the invention which follows is referenced to the drawing, wherein like character numbers refer to like parts throughout, and in which.

DETAILED DESCRIPTION OF THE INVENTION

Figure 2:
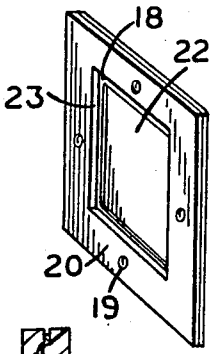
FIG. 2 is an exploded pictorial view of the device of FIG. 1 showing the assembly of its various components.
Figure 1:
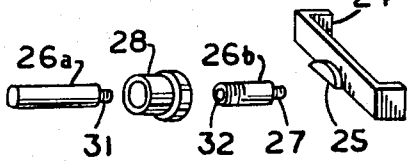
FIG. 1 is a pictorial view of one embodiment of the invention.
Figure 1:
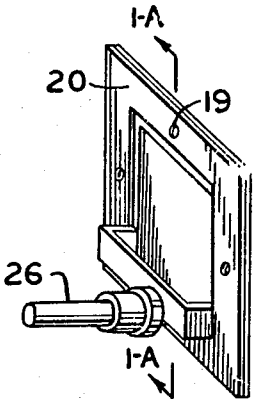
Figure 1A:
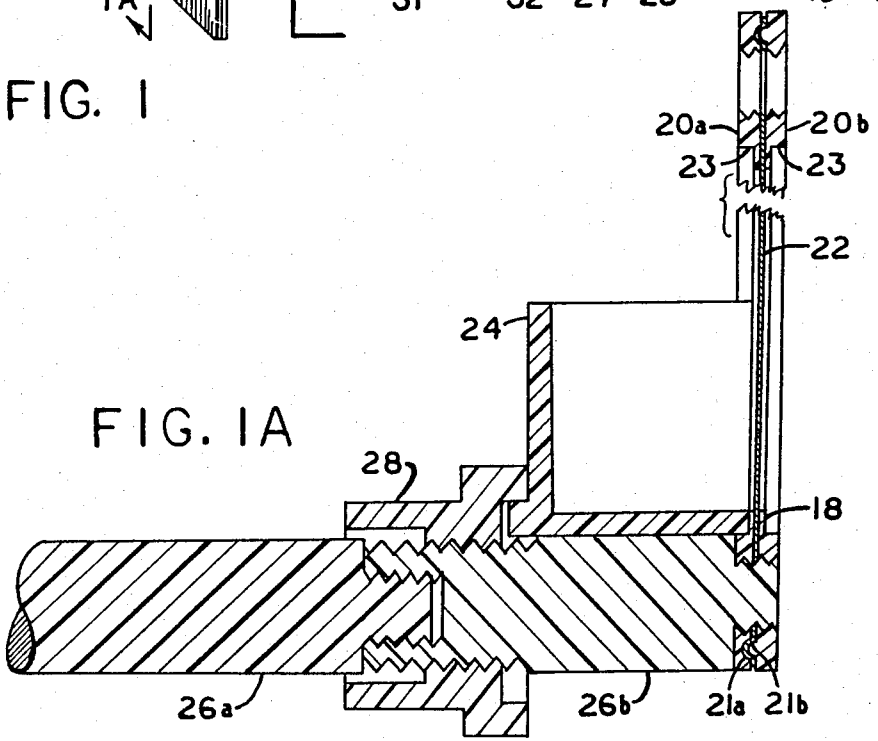
FIG. 1A is a sectional view taken along lines 1-A of FIG. 1.

Referring now to FIGS. 1, 1A and 2, the device comprises a frame 20 provided with threaded holes 19 for securing handle assembly 26 to any selected side of frame 20. Although shown in square shape, frame 20 may be rectangular, hexagonal, octagonal, etc., as well as circular as shown in FIG. 3.

Frame 20 supports serigraphic screen 22, with the inner edges 23 of frame 20 serving to support color-medium hopper 24. The frame and screen assembly is conveniently constructed by sandwiching the screen between two substantially identical frame halves 20*a* and 20*b*, of appreciable thickness, and then adhesively or otherwise joining the frame halves together around their perimeters. Channel 21*a*, mating with perimeter boss 21*b*, are multifunctional in that they simultaneously stretch-lock the screen while aligning the frame halves during assembly.

Hopper 24 is held in fluid-tight relationship against frame 20 by means of a two piece handle assembly 26. The latter comprises an extended shaft portion 26*a* having a threaded extension 31 for engaging hole 32 of shaft portion 26*b*. The leading edge diameter of shaft portion 26*b* is threaded to receive threaded collar 28. Shaft portion 26*b* is also provided with a threaded extension 27 for engaging a selected hole 19 of frame 20. In assembling the device, ring 28 is threaded on shaft portion 26*b* and upon threading extension 27 into hole 19, collar 28 engages a corresponding boss 25 extending outwardly from hopper 24, whereby the latter is held in fluid-tight relationship with sealing lip 18 which extends inwardly from the inside edges of frame 20. As stated, hopper 24 is supported by an edge 23 of frame 20. Although not illustrated, a one piece handle 26 would serve as a substitute for the two piece handle of FIG. 2 if the diameter of portion 26*a* was reduced to pass collar 28.

Figure 3:
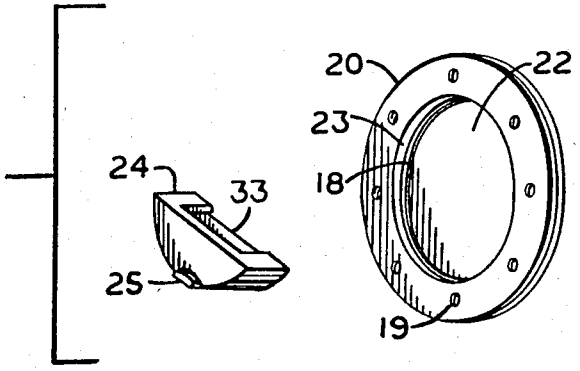
FIG. 3 shows an alternative embodiment of the invention in which the frame is circular and the hopper is segment-shaped with a radius corresponding to that of the frame.

In FIG. 3, frame 20 is shown taking a circular shape with holes 19 being located at pre-selected points, e.g., at 45°, 90°, 135°, etc., around the circumference. Hopper 24 is segment-shaped with its radius corresponding to that of frame 20 so that it may fit in fluid-tight relationship with inner lip 18 of frame 20. It also has a paint dispensing shelf 33 that is geometrically equivalent to a chord of the segment. Hopper 24 is provided with a boss 25 which cooperates with shaft assembly 26b as previously described in connection with FIGS. 1, 1A and 2.

Figure 4:
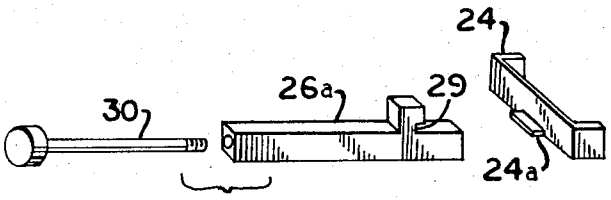
FIG. 4 shows an alternate embodiment of the invention in which different handle and hopper means are provided for assembling the various components of the device.

In FIG. 4, showing an alternative embodiment of the device, hopper 24 is provided with an outwardly extending lip 24a, and shaft portion 26a incorporates an integral notched extension 29 adapted to engage lip 24a of hopper 24. Shaft portion 26a is drilled longitudinally to receive threaded rod 30 which engages a threaded hole 19 of frame 20, thereby holding hopper 24 in fluid-tight relationship with frame 20.

When the device is used in the horizontal "facing down" position, the edge 23 of frame 20 serves to confine the color-medium within the frame; accordingly, hopper 24 may be omitted and handle 26 may be used solely for manipulative purposes. Similarly, when the device is used for overhead transfer, hopper 24 will be omitted. Also, when the device is used in an overhead position, or on textured and otherwise rough surfaces, it is preferred to apply the color-medium by means of a depth displacement squeegee, one type of which is shown in my U.S. Pat. No. 4,398,839.

What is claimed is:

1. A multi-positional transfer device comprising: a serigraphic screen bearing a pattern to be transferred to a surface, said screen being supported by a substantially rigid frame; an open color-medium hopper engaging said frame in liquid-tight relationship, said hopper communicating directly with said screen substantially entirely across one dimension thereof; handle means affixed to said frame and extending outwardly from the plane thereof, said handle means including means for maintaining said hopper in said liquid-tight relationship with said frame; and means for selectively affixing said handle means to each face of said frame.

2. A transfer device as defined in claim 1, wherein said frame is rectilinear in shape.

3. A transfer device as defined in claim 1, wherein said frame is circular in shape.

4. A multi-positional transfer device comprising: a serigraphic screen bearing a pattern to be transferred to a surface, said screen being supported by a substantially rigid frame at least one inner edge of which comprises a lip extending inwardly in the plane of said screen; an open color-medium hopper communicating directly with said screen substantially entirely across one linear dimension thereof and registering with said lip; handle means extending outwardly from the plane of said frame and registering with said hopper and said frame to maintain said hopper in liquid-tight engagement with said frame; and means for selectively affixing said handle means to each face of said frame.

5. A transfer device as defined in claim 4, wherein said hopper is maintained in liquid-tight engagement with said frame by means of a collar threadedly engaging a threaded portion of said handle means and bearing against said hopper.

6. A transfer device as defined in claim 4, wherein said hopper is maintained in liquid-tight engagement with said frame by means of a lug or the like, integral with said handle means and extending substantially perpendicular to the axis thereof, said lug bearing against said hopper.

7. A serigraphic screen structure comprising a serigraphic screen bearing a pattern to be transferred to a surface, said screen being supported between substantially identical frame elements, each of which comprises a lip extending inwardly in the plane of said screen from at least one inner edge thereof and each of which comprises means for threadedly engaging handle means substantially perpendicular to the face thereof at a plurality of points.

* * * * *